US009644562B2

(12) United States Patent
Fujita

(10) Patent No.: US 9,644,562 B2
(45) Date of Patent: May 9, 2017

(54) INJECTOR DRIVING APPARATUS

(71) Applicant: DENSO CORPORATION, Kariya, Aichi-perf. (JP)

(72) Inventor: Syohei Fujita, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/869,460

(22) Filed: Sep. 29, 2015

(65) Prior Publication Data

US 2016/0160783 A1 Jun. 9, 2016

(30) Foreign Application Priority Data

Dec. 3, 2014 (JP) ..... 2014-245126

(51) Int. Cl.
*F02D 41/22* (2006.01)
*F02D 41/20* (2006.01)

(52) U.S. Cl.
CPC ..... *F02D 41/221* (2013.01); *F02D 41/20* (2013.01); *F02D 2041/2058* (2013.01); *F02D 2041/224* (2013.01)

(58) Field of Classification Search
CPC ..... F02D 2041/224; F02D 2041/227; F02D 2041/228; H01H 47/002; G01R 31/3277; G01R 31/3278
USPC ..... 361/166, 167
See application file for complete search history.

(56) References Cited

U.S. PATENT DOCUMENTS 5,633,458 A * 5/1997 Pauli ..... F02D 41/22 701/105
5,784,245 A * 7/1998 Moraghan ..... H01H 47/002 361/152
6,112,148 A * 8/2000 Baraban ..... F02D 41/22 701/107
7,248,959 B2 * 7/2007 Enomoto ..... F02D 41/26 123/179.24
8,776,763 B2 * 7/2014 Omori ..... F02D 41/20 123/445
8,989,994 B2 * 3/2015 Love ..... F02D 41/221 123/478
9,267,992 B2 * 2/2016 Shiraishi ..... G01R 31/327
(Continued)

FOREIGN PATENT DOCUMENTS

GB 2377507 A * 1/2003 ..... F02D 41/20
JP 10252539 A * 9/1998 ..... F02D 41/22
(Continued)

*Primary Examiner* — Hung Q Nguyen
*Assistant Examiner* — Kevin R Steckbauer
(74) *Attorney, Agent, or Firm* — Posz Law Group, PLC

(57) ABSTRACT

In an injector driving apparatus, a driving circuit supplies a current individually to each coil of multiple injectors, a current detection element detects the current flowing in a common current flow path, which is common to the coils, a current supply period guard part forcibly stops the current supplied from the driving circuit to the coil upon determination that a measured period reached a predetermined set period based on a detection result of the current detection element, and a diagnosis part operates in a period of no fuel injection to check whether the current supply period guard part normally stops the current supplied to the coil, by continuously supplying the current to the coil for only a short period, which disables the injector to open a valve, and sequentially switches over the coils.

7 Claims, 6 Drawing Sheets

(56) References Cited

U.S. PATENT DOCUMENTS

| | | | | |
|---|---|---|---|---|
| 2006/0287805 | A1* | 12/2006 | Enomoto | F02D 41/26 701/113 |
| 2008/0229817 | A1* | 9/2008 | Hartmann | F02D 41/221 73/114.79 |
| 2010/0242920 | A1* | 9/2010 | Omori | F02D 41/20 123/490 |
| 2012/0179353 | A1* | 7/2012 | Anilovich | F02D 41/22 701/101 |
| 2013/0320986 | A1* | 12/2013 | Shiraishi | G01R 31/327 324/415 |
| 2014/0012484 | A1* | 1/2014 | Love | F02D 41/221 701/103 |
| 2014/0176140 | A9* | 6/2014 | Shiraishi | G01R 31/327 324/415 |
| 2015/0152820 | A1* | 6/2015 | Kojima | F01L 9/04 123/479 |
| 2016/0084908 | A1* | 3/2016 | Shiraishi | G01R 31/327 324/415 |
| 2016/0160783 | A1* | 6/2016 | Fujita | F02D 41/221 701/103 |

FOREIGN PATENT DOCUMENTS

| | | | |
|---|---|---|---|
| JP | H11-247698 | A | 9/1999 |
| JP | 2007-205249 | A | 8/2007 |
| JP | 2009-2295 | A | 1/2009 |

* cited by examiner

INJECTOR DRIVING APPARATUS

CROSS REFERENCE TO RELATED APPLICATION

This application is based on Japanese patent application No. 2014-245126 filed on Dec. 3, 2014, the disclosure of which is incorporated herein by reference.

FIELD

The present disclosure relates to an injector driving apparatus for driving injectors.

BACKGROUND

One conventional injector for injecting fuel into an engine of a vehicle is electro-magnetically operated to open in response to supply of a current to a coil. In an injector driving apparatus for driving multiple injectors, a selection switch is provided at a low-side (low-potential side) of a coil of each injector to select a coil (injector to be driven), to which a current is supplied. Thus, the current is supplied to only the coil corresponding to the selection switch, which is turned on, among multiple switches. In a case that the multiple injectors are not driven for fuel injection at the same time, a current detection element is shared to detect the current supplied to each coil. Specifically, a resistor is provided as the current detection element in a current supply path, through which the current flows to the coils in common (for example, JP 2007-205249 A).

In an engine control system for a vehicle, a power output of the engine is limited when an abnormality arises. One proposal is to provide an injector driving apparatus with a current supply period guard function, which limits a time period of current supply to a coil of an injector to a predetermined period. With the limited period of current supply of the coil, a quantity of fuel injected from the injector is limited and hence the power output of the engine is limited. The current supply period guard function specifically measures a period of continuous flow of the current in the coil and, when the measured period reaches a predetermined period, forcibly stops the current supply to the coil.

If a current is simply supplied to the coil of the injector to diagnose whether the current supply period guard function is normal or not, the injector is driven to inject fuel unnecessarily.

SUMMARY

It is therefore an object to enable a diagnosis of a current supply period guard function, which limits a current supply period to a coil of an injector, in an injector driving apparatus without causing the injector to inject fuel unnecessarily.

According to one aspect, an injector driving apparatus comprises a driving circuit, a common current flow path, a current detection element, a current supply period guard part and a diagnosis part, a driving circuit for supplying a current individually to coils of multiple injectors mounted on an engine of a vehicle. The common current flow path allows the current to flow in the coils therethrough. The current detection element is provided in the common current flow path for detecting the current flowing in the common current flow path as a current, which flows to the coils. The current supply period guard part measures a period, during which the current continues to flow in the common current flow path, based on a detection result of the current detection element, and forcibly stops the current supplied from the driving circuit to the coils when a measured period reaches a predetermined set period. The diagnosis part checks whether the current supply period guard part normally stops the current supplied from the driving circuit to the coils, by supplying the current to each of the coils for a period shorter than a minimum period, which enables the injector to open a valve, and sequentially switches over the coils thereby to continuously supply the current to the common current flow path. The diagnosis part performs a checking operation in a period of no fuel injection into the engine.

EMBODIMENT

An electronic control unit, which is configured as an injector driving apparatus, will be described below with reference to embodiments. In the following description, the electronic control unit is referred to as an ECU.

First Embodiment

Figure 1:
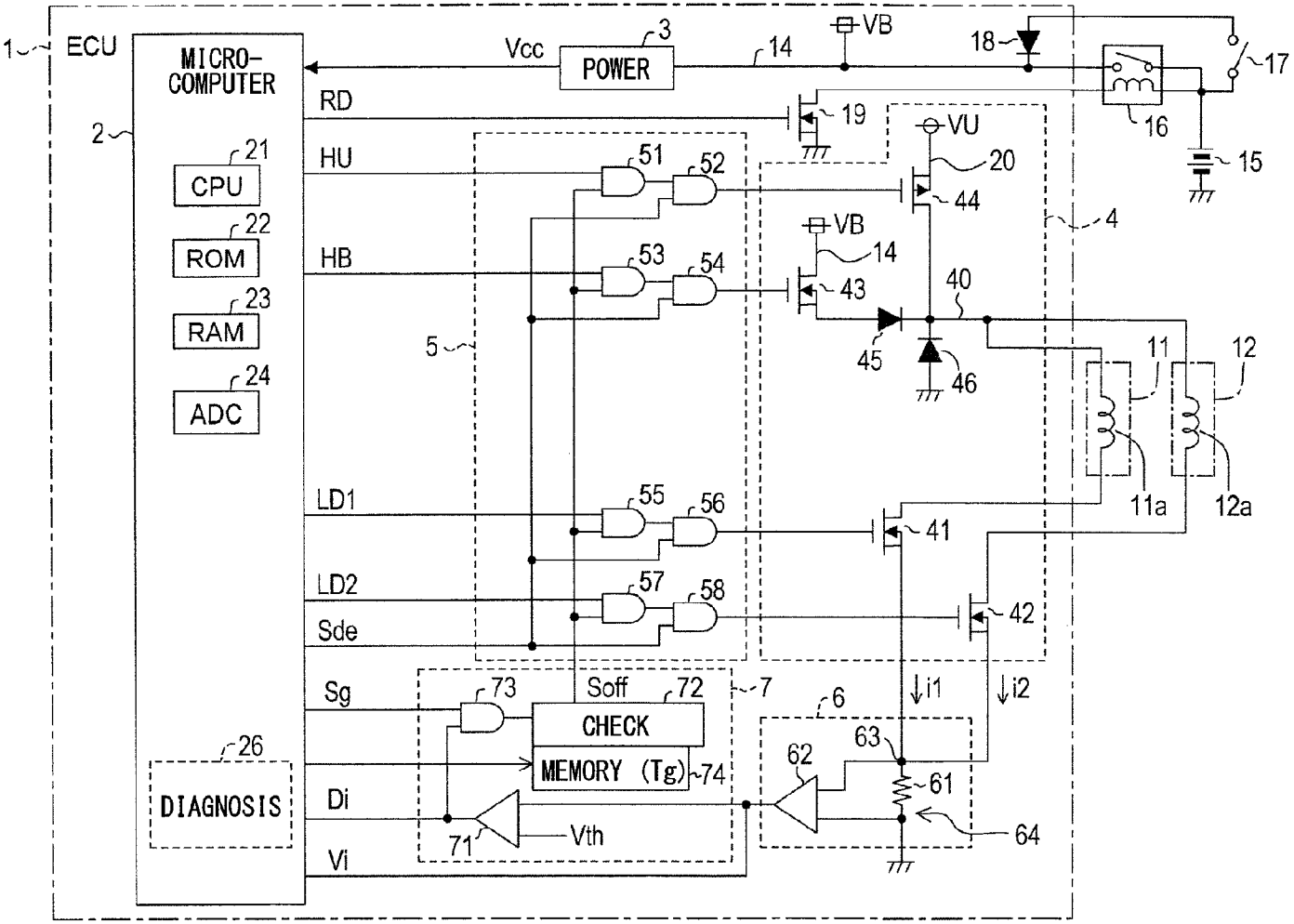
FIG. 1 is a circuit diagram showing a configuration of an injector driving apparatus according to a first embodiment.

An ECU 1 according to a first embodiment is configured as shown in FIG. 1 to control fuel injection for an engine of a vehicle by driving multiple injectors mounted on the engine. The engine has four cylinders, for example. Although the injector is mounted on each cylinder of the engine, only two injectors 11 and 12 are exemplarily illustrated in FIG. 1. The injector 11 and the injector 12 are mounted on cylinders, into which fuel is not injected at the same time. The following description is directed to driving of the injectors 11 and 12. The injectors 11 and 12 are operable electro-magnetically to open respective valves when respective inside coils 11*a* and 12*a* are supplied with currents.

As shown in FIG. 1, the ECU 1 includes a microcomputer 2 for centrally controlling operations of the ECU 1, a power circuit 3, a driving circuit 4 for driving the injectors 11 and 12, a driving control circuit 5 for operating the driving circuit 4, and a current detection circuit 6 and a current supply period guard circuit 7. The current detection circuit 6 and the current supply period guard circuit 7 are provided in common for the injectors 11 and 12. The injectors 11 and 12 are driven to open respective valves in response to supply of currents to coils 11*a* and 12*a* of the injectors 11 and 12, respectively.

The microcomputer 2 includes a CPU 21 for execution of programs, a ROM 22 for storing the programs and fixed data, a RAM 23 for storing results of arithmetic operations of the CPU 21 and an A/D converter (ADC) 24. Although not illustrated, the microcomputer 2 further includes a non-volatile memory, which is capable of rewiring of data. As an operation of the microcomputer 2, the CPU 21 executes the programs stored in the ROM 22.

A battery voltage VB, which is a positive-terminal voltage of a battery 15 mounted in the vehicle, is supplied to a first power line 14 in the ECU 1 through a main relay 16, which is provided as a power relay. The battery voltage VB is supplied to the first power line 14 also through an ignition switch 17 and a diode 18. The ECU 1 is further provided with a relay driving switch 19, which turns on the main relay 16 in response to a relay driving signal RD outputted from the microcomputer 2. In the ECU 1, the power circuit 3 steps down the battery voltage VB supplied from the first power line 14 and outputs a constant power voltage Vcc (for example, 5V), which the microcomputer 2 needs to operate.

When a vehicle user turns on the ignition switch 17, the power circuit 3 outputs the power voltage Vcc to activate the microcomputer 2. Following the activation, the microcomputer 2 sets the relay driving signal RD to an active level (high level, for example) to turn on the relay driving switch 19 and the main relay 16. As a result, even when the ignition switch 17 is turned off after the activation of the microcomputer 2 by the turn-on of the ignition switch 17, the battery voltage VB is supplied persistently to the first power line 14 through the main relay 16 and hence the microcomputer 2 is maintained operable.

Upon determination that the ignition switch 17 is turned off, the microcomputer 2 performs shut-down processing, which is to be finished before stopping its operation and then sets the relay driving signal RD to an inactive level (low level, for example) to turn off the main relay 16. Supply of the battery voltage VB to the first power line 14 is shut down so that the microcomputer 2 does not operate.

Although not shown, a signal indicating an on/off state of the ignition switch 17 (IGSW signal) is inputted to the microcomputer 2 through an input circuit. The microcomputer 2 is thus enabled to check whether the ignition switch 17 is in the on-state or the off-state based on the IGSW signal. As a modification, the relay driving switch 19 may be configured to turn on as a result of an OR logic between the relay driving signal RD from the microcomputer 2 and the IGSW signal. In this modification, a diode 18 need not be provided.

The driving circuit 4 includes a current output line 40, a first selection switch 41 and a second selection switch 42. The current output line 40 is connected to the coils 11*a* and 12*a* of the injectors 11 and 12 at high-potential ends, which are connected in common. One output terminal of the first selection switch 41 is connected to a low-potential end of the coil 11*a*. One output terminal of the second selection switch 42 is connected to a low-potential end of the coil 12*a*. The low-potential ends of the coils 11*a* and 12*a* are opposite to the current output line 40 side (high-potential ends) of the coils 11*a* and 12*a*. The other output terminal of the first selection switch 41, which is opposite to the coil 11*a* side, and the other output terminal of the second selection switch 42, which is opposite to the coil 12*a* side, are connected to a ground line of 0V through a current detection resistor 61 described below.

The driving circuit 4 further includes a first high-side switch 43 and a second high-side switch 44, which are provided at high potential end sides of the coils 22*a* and 12*a*. One output terminal of the first high-side switch 43 is connected to the first power line 14, which supplies the battery voltage VB. One output terminal of the second high-side switch 44 is connected to a second power line 20 in the ECU 1. The other output terminal of the second high-side switch 44 is connected to the current output line 40. A boosted voltage VU, which is an output voltage of a voltage booster circuit (not shown), is supplied to the second power line 20. Although not illustrated, the voltage booster circuit is a voltage-boosting type DC/DC converter, which charges a capacitor by stepping up the battery voltage VB of the first power line 14. A charge voltage of the capacitor is the boosted voltage VU (50V, for example) higher than the battery voltage VB.

The driving circuit 4 further includes a diode 45 for blocking a current from flowing in reverse and a diode 46 for fly-wheeling a current. An anode of the diode 45 is connected to the other output terminal of the first high-side switch 43, which is opposite to the first power line 14 side. A cathode of the diode 45 is connected to the current output power line 40. An anode of the diode 46 is connected to the ground line and a cathode of the diode 46 is connected to the power output line 40.

The current detection circuit 6 includes an amplifier circuit 62 in addition to the current detection resistor 61. One end of the current detection resistor 61 is connected in common to the output terminal of the first selection switch 41, which is opposite to the coil 11*a* side, and the output terminal of the second selection switch 42, which is opposite to the coil 12*a* side. The other end of the current detection resistor 61 is connected to the ground line.

That is, a current flow path between a node 63, at which the output terminals of the first selection switch 41 and the second selection switch 42 opposite to the coils 11*a* and 12*a* sides are connected, and the ground line form a common current flow path 64, which allows currents i1 and i2 of the coils 11*a* and 12*a* to flow. The current detection resistor 61 is provided in the common current flow path 64. The current detection resistor 61 is thus a part of the common current flow path 64. The current i1 flows in the coil 11*a* through the first selection switch 41. The current i2 flows in the coil 12*a* through the second selection switch 42.

The amplifier circuit 62 amplifies a difference between voltages at both ends of the current detection resistor 61 and outputs an amplified voltage signal as a current detection signal Vi, which indicates a current flowing in the coil 11*a* or 12*a* (current flowing in the common current flow path 64). The current detection signal Vi, which corresponds to a detection result of the current detection resistor 6, is inputted to the microcomputer 2 and the current supply period guard circuit 7.

The current supply period guard circuit 7 includes a comparator circuit 71, a check circuit 72, an AND circuit 73 and a memory 74. The comparator circuit 71 compares the current detection signal Vi of the current detection circuit 6 with a threshold signal Vth, which is a voltage signal. The comparison circuit 71 outputs a high-level signal and a low-level signal when the current detection signal Vi is equal to or higher than the threshold signal Vth and lower than the threshold signal Vth, respectively. The output signal of the comparator circuit 71 is inputted to the AND circuit 73 and also to the microcomputer 2 as a diagnosis signal Di.

The AND circuit 73 outputs the output signal of the comparator circuit 71 to the check part 72 without change when a current supply guard setting signal Sg of the microcomputer 2 has a level (high level, for example), which makes the function of the current supply period guard circuit 7 effective. The AND circuit 73 maintains the output signal to the check part 72 at the other level (low level, for example), which makes the function of the current supply period guard circuit 7 ineffective.

The check part 72 measures a period, during which the output signal of the AND circuit 73 continues to be at the high level. When a measured period reaches a guard period Tg stored in the memory 74, the check part 72 sets a forced-off command signal Soff, which is inputted to the driving control circuit 5, to a low level. The guard period Tg is a predetermined set period. The forced-off command signal Soff is a low-active signal, which indicates forcibly stopping the current supply from the driving circuit 4 to the coils 11*a* and 12*a*. When the measured period does not reach the guard period Tg stored in the memory 74 or the current supply guard setting signal Sg is at the low level, the check part 72 sets the forced-off command signal Soff, which is inputted to the driving control circuit 5, to a high level.

When the current supply guard setting signal Sg is at the high level, a current equal to or higher than a fixed value Ith continues to flow in either of the coils 11*a* and 12*a* as long as the output signal of the AND circuit 73 continues to be at the high level. The fixed value Ith corresponds to a voltage value corresponding to the threshold signal Vth, which the comparator circuit 71 uses. Specifically, assuming that the current detection resistor 61 has a resistance value R and the amplifier circuit 62 has an amplification gain G, the fixed value is defined as follows.

$$Ith=Vth/(R\times G)$$

For this reason, the current detection circuit 6 operates when the current supply guard setting signal Sg from the microcomputer 2 is at the high level and measures the period of continuous flow of the current in the coil 11*a* or 12*a* based on the current detection signal Vi of the current detection circuit 6. When the measured period reaches the guard period Tg, the current supply period guard circuit 7 changes the forced-off command signal Soff from the high level to the low level.

The guard period Tg in the memory 74 is set for the current supply period guard circuit 7 and is variable with data from the microcomputer 2. The guard period Tg is not limited to a variable value but may be a fixed value.

The forced-off command signal Soff is inputted to the driving control circuit 5 from the current supply period guard circuit 7 as described above. Further, a boosted-voltage application signal HU, a battery voltage application signal HB, a first low-side driving signal LD1, a second low-side driving signal LD2 and a current supply prohibition signal Sde are inputted to the driving control circuit 5 from the microcomputer 2.

The boosted-voltage application signal HU is a command signal, which is high-active, for turning on the second high-side switch 44 to supply the boosted voltage VU to the ends of the coils 11*a* and 12*a* at the high potential side. The battery voltage application signal HB is a command signal, which is also high-active, for turning on the first high-side switch 43 to supply the battery voltage VB to the ends of the coils 11*a* and 12*a* at the high potential side. The first low-side driving signal LD1 is a command signal, which is high-active, for turning on the first selection switch 41 to supply the current to the coil 11*a*. The second low-side driving signal LD2 is a command signal, which is high-active, for turning on the second selection switch 42 to supply the current to the coil 12*a*. The current supply prohibition signal Sde is a command signal, which is low-active similarly to the forced-off command signal Soff, for forcibly stopping the current supply to the coils 11*a* and 12*a*.

The driving control circuit 5 includes AND circuits 51 to 58. The AND circuit 51 outputs a logical-product signal of the boosted-voltage application signal HU and the forced-off command signal Soff. The AND circuit 52 turns on the second high-side switch 44 when both of the output signal of the AND circuit 51 and the current supply prohibition signal Sde are at the high levels. The AND circuit 52 turns off the second high-side switch 44 when at least one of the output signals of the AND circuit 51 and the current supply prohibition signal Sde is at the low level.

The AND circuit 53 outputs a logical-product signal of the battery voltage application signal HB and the forced-off command signal Soff. The AND circuit 54 turns on the first high-side switch 43 when both of the output signal of the AND circuit 53 and the current supply prohibition signal Sde are at the high levels. The AND circuit 54 turns off the first high-side switch 43 when at least one of the output signals of the AND circuit 53 and the current supply prohibition signal Sde is at the low level. The AND circuit 55 outputs a logical-product signal of the first low-side driving signal LD1 and the forced-off command signal Soff. The AND circuit 56 turns on the first selection switch 41 when both of the output signal of the AND circuit 55 and the current supply prohibition signal Sde are at the high levels. The AND circuit 56 turns off the first selection switch 41 when at least one of the output signals of the AND circuit 55 and the current supply prohibition signal Sde is at the low level.

The AND circuit 57 outputs a logical-product signal of the second low-side driving signal LD2 and the forced-off command signal Soff. The AND circuit 58 turns on the second selection switch 42 when both of the output signal of the AND circuit 57 and the current supply prohibition signal Sde are at the high levels. The AND circuit 58 turns off the second selection switch 42 when at least one of the output signals of the AND circuit 57 and the current supply prohibition signal Sde is at the low level.

When both of the forced-off command signal Soff and the current supply prohibition signal Sde are at the high levels, the driving control circuit 5 turns on/off the second high-side switch 44 in response to the high/low level of the boosted-voltage application signal HU and turns on/off the first high-side switch 43 in response to the high/low level of the battery voltage application signal HB. Similarly, when both of the forced-off command signal Soff and the current supply prohibition signal Sde are at the high levels, the driving control circuit 5 turns on/off the first selection switch 41 in response to the high/low level of the signal LD and turns on/off the second selection switch 42 in response to the high/low level of the second low-side driving signal LD2. On the other hand, when at least one of the forced-off command signal Soff and the current supply prohibition signal Sde is at the low level, the driving control circuit 5 forcibly turns off all the switches 41 to 44 in the driving circuit 4 irrespective of the signals HU, HB, LD1 and LD2 outputted from the microcomputer 2.

Processing of the microcomputer 2 will be described next.

(Fuel Injection Control Processing)

The microcomputer 2 calculates a start timing of fuel injection and a quantity of fuel injection for each cylinder based on an engine rotation speed, accelerator position varied by a vehicle driver and the like, and then calculates a driving period of each injector 11, 12 based on such calculation results. As the driving period of the injector, the microcomputer 2 calculates a start timing of current supply to the coil of the injector and a period of current supply to the coil of the injector. In normal time, the microcomputer 2 sets the current supply prohibition signal Sde for the driving control circuit 5 to the high level and sets the current supply guard setting signal Sg for the current supply period guard circuit 7 to the low level. Thus, both of the forced-off command signal Soff and the current supply prohibition signal Sde outputted to the driving control circuit 5 are at the low levels.

Figure 2:
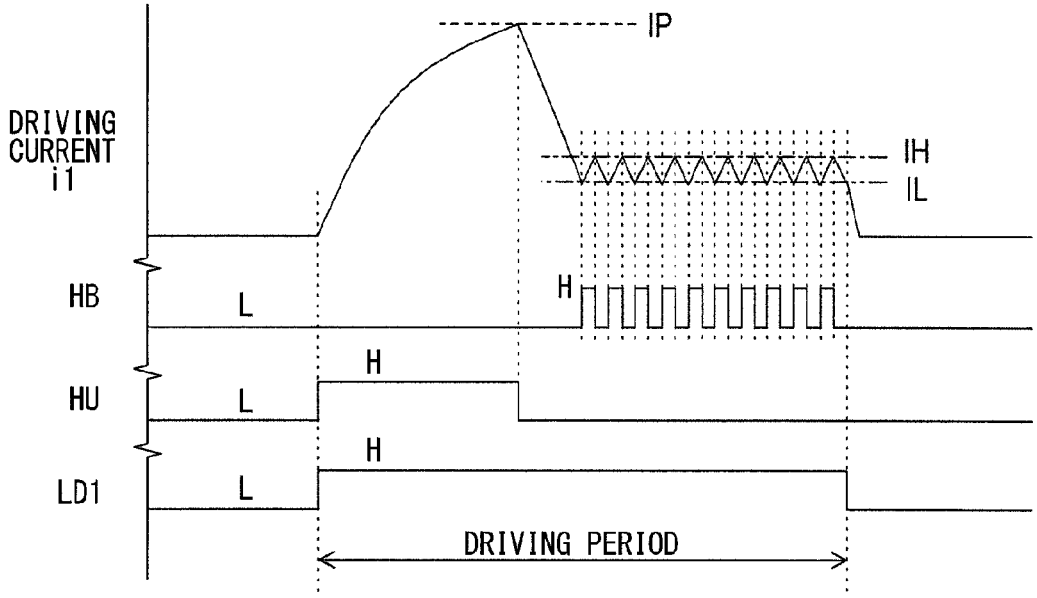
FIG. 2 is a time chart showing an operation of fuel injection control processing performed by a microcomputer in the first embodiment.

Driving of the injector 11 will be described below as one representative example among multiple injectors for multiple cylinders. As shown in FIG. 2, the microcomputer 2 sets the first low-side driving signal LD1 to the high level (indicated as H in FIG. 2) and turns on the first selection switch 41 during the driving period of the injector 11. Further, the microcomputer 2 sets the boosted-voltage application signal HU to the high level and turns on the second high-side switch 44 at the start time of the driving period of the injector 11 (that is, at start timing of current supply to the coil 11*a*).

Thus the first selection switch 41 turns on with the boosted voltage VU being applied to the high-side end part of the coil 11*a*. The current supply to the coil 11*a* is started with the boosted voltage VH as a power supply. In this case, the capacitor discharges to the coil 11*a*.

During the driving period of the injector 11, the microcomputer 2 detects the current i1 flowing in the coil 11*a* by ND-converting the current detection signal Vi outputted from the current detection circuit 6. When the microcomputer 2 detects that the current i1 reached a target maximum value IP of the current supply start time after setting of the boosted-voltage application signal HU to the high level, the microcomputer 2 sets the boosted-voltage application signal HU to the low level (indicated as L in FIG. 2) and turns off the second high-side switch 44. By supplying the boosted voltage VU higher than the battery voltage VB as the power supply source and thereby supplying the current to the coil 11*a* at the start time of the current supply, a valve-opening response of the injector 11 is speeded up. The microcomputer 2 may set the boosted-voltage application signal HU for only a fixed period.

After setting the boosted-voltage application signal HU at the low level, the microcomputer 2 performs constant current control by turning on and off the first high-side switch 43 so that the current i1 is regulated to a fixed current lower than the target maximum value IP. For example, the microcomputer 2 sets the battery voltage application signal HB to the high level and turns on the first high-side switch 43 by detecting that the current i1 fell to a low-side threshold value IL. The microcomputer 2 sets the battery voltage application signal HB to the low level and turns off the first high-side switch 43 by detecting that the current i1 rose to a high-side threshold value IH (>IL). When the first high-side switch 43 turns on, the current flows to the coil 11*a* with the battery voltage VB of the first power line 14 as the power supply source. When the first high-side switch 43 turns off, the current flywheels to the coil 11*a* from the ground line through the diode 46.

Then the microcomputer 2 sets the first low-side driving signal LD1 to the low level and turns off the first selection switch 41 at the end time of the driving period of the injector 11. The microcomputer 2 sets the battery voltage application signal HB to the low level and turns off the first high-side switch 43. Thus the current supply to the coil 11*a* is stopped and the valve of the injector 11 closes. For driving the injector 12, the second low-side driving signal LD2 is set to the high level in place of setting the first low-side driving signal LD1 to the high level.

<Engine Power Output Limitation Processing>

When the microcomputer 2 detects an abnormality such as an abnormality in a monitor circuit for checking whether the microcomputer 2 is normal or not or an abnormality in a function of controlling a throttle of the engine, which will possibly cause the engine to produce an excessive power output, the microcomputer 2 causes the current supply period guard circuit 7 to perform its limiting function. Specifically, the microcomputer 2 sets the guard period Tg for the current supply period guard circuit 7 and sets the current supply guard setting signal Sg for the current supply period guard circuit 7 to the high level.

When the current supply guard setting signal Sg becomes the high level, the current supply period guard circuit 7 measures the period of continuous flow of current in the coil 11*a* or 12*a*. When the measured period reaches the guard period Tg, the current supply period guard circuit 7 sets the forced-off command signal Soff to the low level.

When the forced-off command signal Soff changes to the low level, the driving control circuit 5 forcibly turns off all the switches 41 to 44 in the circuit 4. Thus the current supply from the circuit 4 to the coils 11*a* and 11*b* is forcibly stopped.

When the current supply period guard circuit 7 performs its function, the current supply period for the coils 11*a* and 12*a* is limited to the guard period Tg. As a result, the quantity of fuel injection from the injectors 11 and 12 is limited and the power output of the engine is limited. Safety of a vehicle is thus improved.

The microcomputer 2 has a higher reliability in its hardware and software (collectively referred to as resource) provided for performing the output limitation processing than in its other resource provided for performing the fuel injection control processing.

(Guard Function Diagnosis Processing)

The microcomputer 2 further performs guard function diagnosis processing for checking whether the function of the guard circuit 7 is normal or not.

In FIG. 1, the diagnosis function part 26 illustrated inside the microcomputer 2 corresponds to a resource, which is for performing the guard function diagnosis processing, among resources of the microcomputer 2. The diagnosis function part 26 is ensured to have its reliability level equal to or higher than that of the resource, which performs the engine power output limitation processing.

Figure 3:
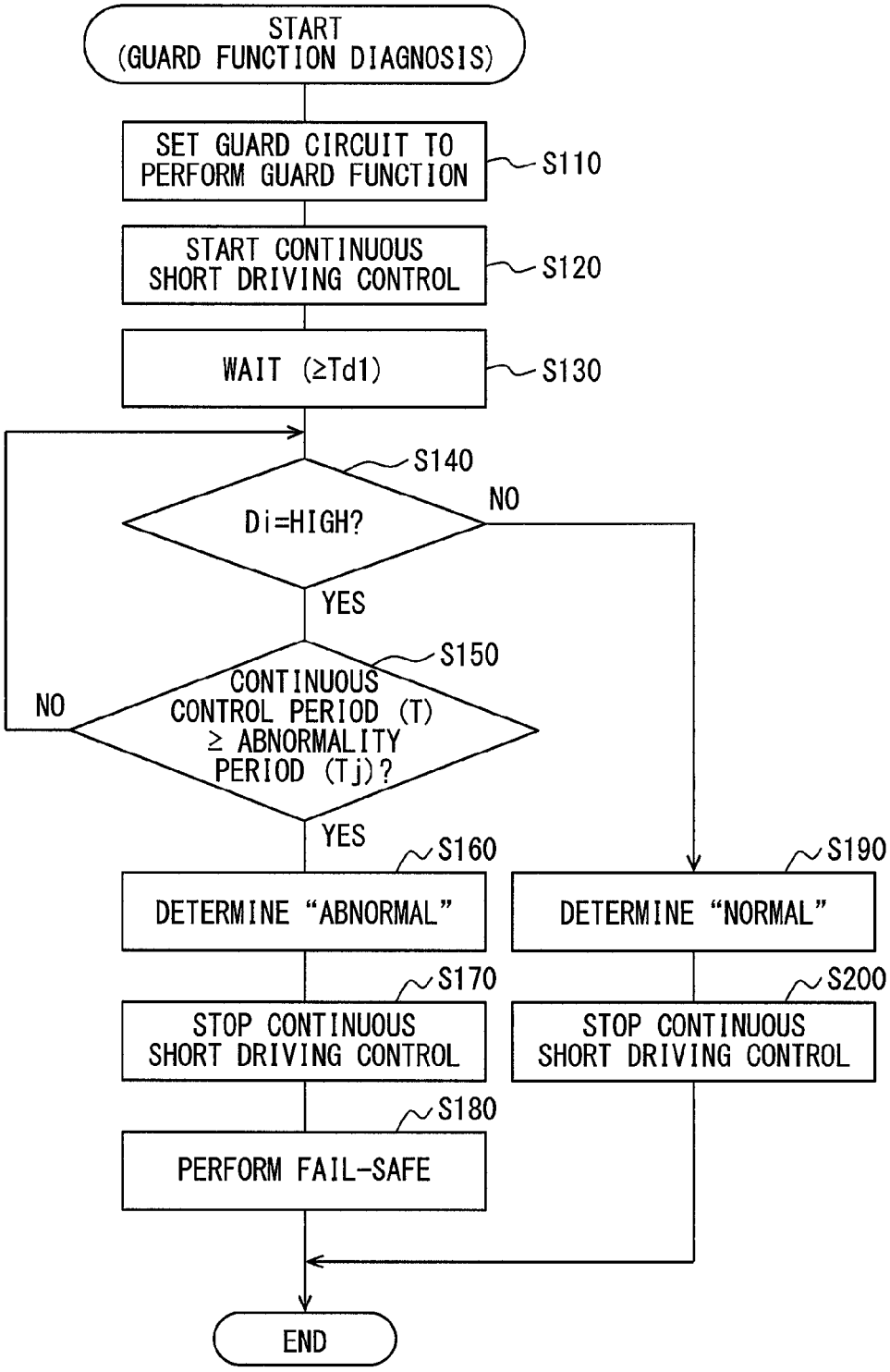
FIG. 3 is a flowchart showing guard function diagnosis processing performed in the first embodiment.

The microcomputer 2 performs the guard function diagnosis processing shown in FIG. 3 in each of the following periods <1> to <4>, in which no fuel injection into the engine is performed.

<1> Period from a turn-off of the ignition switch 17 to an end of power supply to the ECU 1, that is, until main the relay 1 is turned off.

In this case, the microcomputer 2 performs the guard function diagnosis processing shown in FIG. 3 as a part of the shutdown processing.

<2> Period from a turn-on of the ignition switch 17 to a start of the engine, that is, cranking by a starter.

<3> Period of automatic stop of the engine by idle-stop control.

The idle-stop control automatically stops the engine when a predetermined automatic stop condition is satisfied in the course of engine operation and then automatically restarts the engine when a predetermined automatic restart condition is satisfied. This idle-stop control processing may be performed by the microcomputer 2 in the ECU 1 or a microcomputer in other ECUs.

<4> Period of fuel shut-off for the engine upon deceleration of the vehicle.

The fuel shut-off prohibits the fuel injection from the injector. The microcomputer 2 performs fuel shut-off control processing as well. According to the fuel shut-off control processing, the injector is prohibited from injecting fuel, when an accelerator is not operated at all by a driver and a vehicle speed is higher than a predetermined value, for example.

As shown in FIG. 3, the microcomputer 2 causes the current supply period guard circuit 7 to perform its period guard function at S110 after starting the guard function diagnosis processing. Specifically, the microcomputer 2 sets the guard period Tg for the current supply period guard circuit 7 and sets the current supply guard setting signal Sg to the high level. In a case that the guard period Tg need not be varied for diagnosing the function of the current supply period guard circuit 7, the microcomputer 2 may only set the current supply guard setting signal Sg to the high level as S110.

The microcomputer 2 then starts at next S120 continuous short-period driving control, which is indicated as continuous short driving control or continuous control or similar abbreviated form in the figures. Here it is noted that a minimum value of a period of current supply to the coil 11*a*, 12*a* for enabling the injector 11, 12 to open its valve for fuel injection is referred to as a valve-opening minimum period.

The continuous short-period driving control is for performing a continuous supply of a current to the common current flow path 64 by causing the driving circuit 4 to supply the current to the coil 11*a*, 12*a* for only a fixed period Ts, which is shorter than the valve-opening minimum period, and switching over the coils sequentially, to which the current is supplied for only the fixed period Ts.

Figure 4:
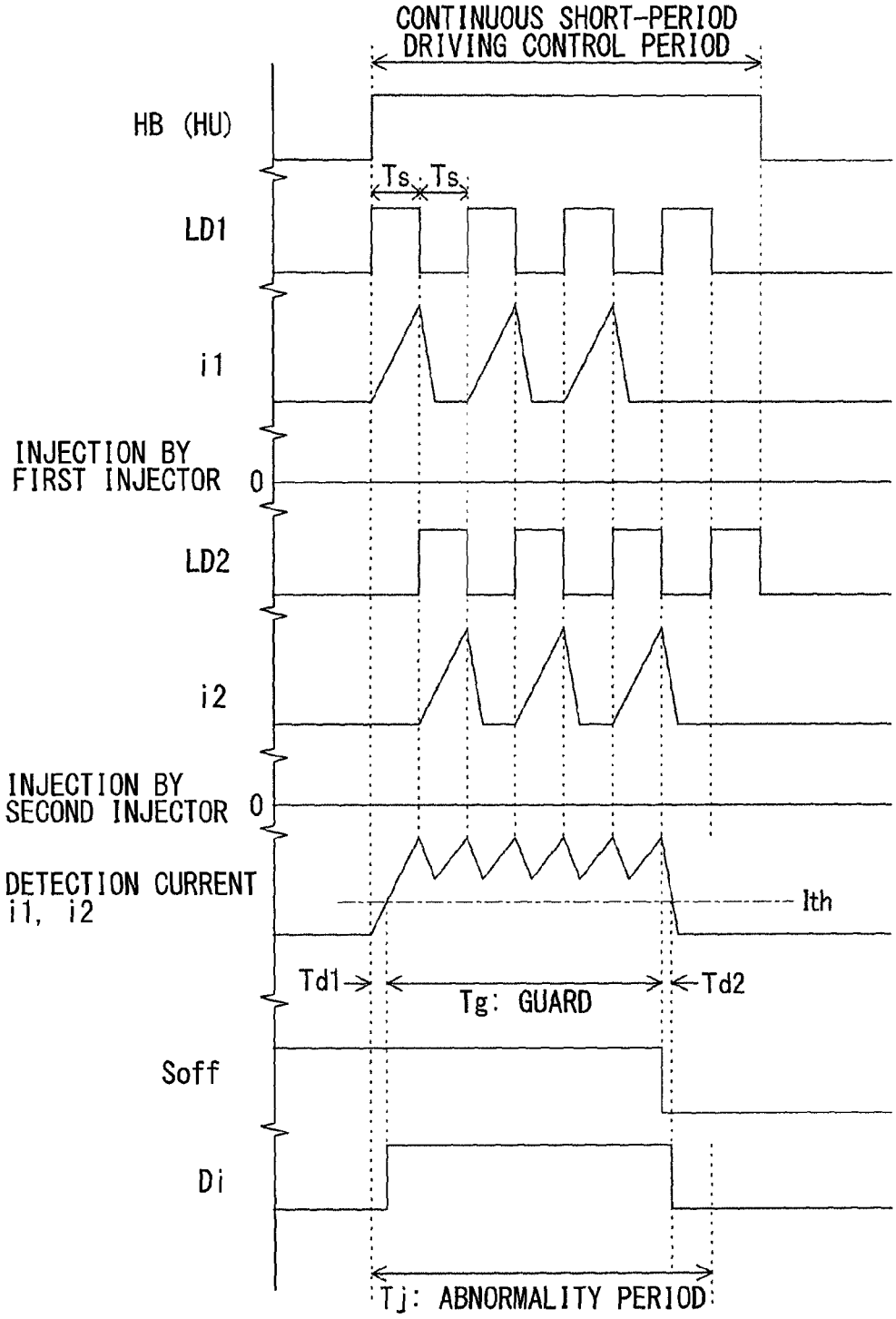
FIG. 4 is a time chart showing an operation of the guard function diagnosis processing shown in FIG. 3.

Specifically, as shown in FIG. 4, the microcomputer 2 sets the battery voltage application signal HB to the high level and turns on the first high-side switch 43 as the continuous short-period driving control. Further, as the continuous short-period driving control, the microcomputer 2 sets the first low-side driving signal LD1 and the second low-side driving signal LD2 to the high level for the fixed period Ts alternately thereby to turn on the first selection switch 41 and the second selection switch 42 for the fixed period Ts alternately. Thus, while limiting the fuel injection quantity of the injectors 11 and 12 to be 0 (that is, disabling fuel injection from the injectors 11 and 12), the current is continuously supplied to the common current flow path 64.

In FIG. 4, the injection by the first injector and the injection by the second injector are the quantity of fuel injection from the injector 11 and the quantity of fuel injection from the injector 12, respectively. In FIG. 4 and the following description, the detection current is the current i1, i2 detected by the current detection circuit 6 and the current, which flows in the common current flow path 64. In the continuous short-period driving control, the boosted-voltage application signal HU may be set to the high level to turn on the second high-side switch 44 in place of setting the battery voltage application signal HB to the high level. Further, in the continuous short-period driving control, both of the battery voltage application signal HB and the boosted-voltage application signal HU may be set to the high levels, respectively.

Referring back to FIG. 3, the microcomputer 2 waits for an elapse of a predetermined period at next S130 after starting the continuous short-period driving control at S120. The predetermined period provided for waiting at S130 is set to be equal to or slightly longer than a period Td1 (refer to FIG. 4), which is a period from when the continuous short-period driving control is started to when the detection current reaches the fixed value Ith and the diagnosis signal Di is set to the high level.

After waiting for the predetermined period at S130, the microcomputer 2 checks at S140 whether the diagnosis signal Di outputted from the comparator circuit 71 is at the high level. When the diagnosis signal Di is at the high level, the microcomputer 2 performs S150.

The microcomputer 2 checks at S150 whether a continuous control period T of performing the continuous short-period driving control (that is, elapse of time from starting the continuous short-period driving control) reached an abnormality determination period Tj, which is indicated as an abnormality period Tj in the figures.

It is assumed here that, as shown in FIG. 4, that the forced-off command signal Soff outputted from the current supply period guard circuit 7 changes to the low level in the course of performing the continuous short-period driving control. In FIG. 4, a period Td2 indicates a period from when the forced-off command signal Soff changes to the low-level to when the detection current falls to the fixed value Ith and the diagnosis signal to the microcomputer 2 becomes the low level. The abnormality determination period Tj is set to be slightly longer than a sum of the guard period Tg in the current supply period guard circuit 7 and the periods Td1 and Td2.

Referring back to FIG. 3, when the microcomputer 2 determines at S150 that the elapse of time of performing the continuous short-period driving control does not reach the abnormality determination period Tj, the microcomputer 2 performs S140 again. When the microcomputer 2 determines at S150 that the elapse of time of performing the continuous short-period driving control reached the abnormality determination period Tj, the microcomputer 2 determines at S160 that the function of the current supply period guard circuit 7 is abnormal (that is, circuit 7 is not operating normally).

That is, the microcomputer 2 performs S160 following S150 in a case that, even when the abnormality determination period Tj elapses after starting of the continuous short-period driving control, the forced-off command signal Soff outputted from the current supply period guard circuit 7 does not change to the low level and the diagnosis signal Di remains at the high level. That is, although the common current flow path 64 is supplied with the current continuously for the abnormality determination period Tj, which is longer than the guard period Tg, the current supply period guard circuit 7 fails to stop the current supply from the circuit 4 to the coils 11*a* and 12*a*. In this case, the microcomputer 2 determines that the function of the current supply period guard circuit 7 is abnormal.

The microcomputer 2 thus stops the continuous short-period driving control at next S170. Specifically, the microcomputer 2 changes the battery voltage application signal HB, which has been set to the high level, to the low level and further maintains the first low-side driving signal LD1 and the LD2, which have been set to the high/low levels, to be at the low levels. The microcomputer 2 then performs the predetermined fail-safe processing at S180 and finishes the guard function diagnosis processing.

When the microcomputer 2 determines at S140 that the diagnosis signal Di is not at the high level (that is, at the low level), the microcomputer 2 performs S190. The microcomputer 2 performs S190 following S140, when the diagnosis signal Di becomes the low level normally as a result of setting the forced-off command signal Soff to the low level by the current supply period guard circuit 7 and prohibiting the circuit 4 from supplying the current to the coil 11*a* and 12*a*. The microcomputer 2 thus determines that the function of the guard circuit 7 is normal. It is noted that FIG. 4 shows a case that the function of the current supply period guard circuit 7 is normal. The microcomputer 2 then stops the continuous short-period driving control at S200 and finishes the guard function diagnosis processing.

In any of cases that the microcomputer 2 determines that the function of the current supply period guard circuit 7 is abnormal at S160 and normal at S190, the current is supplied to the common current flow path 64 by the continuous short-period driving control for a period longer than the guard period Tg.

<Fail-Safe Processing>

The fail-safe processing, which the microcomputer 2 performs at S180 in the guard function diagnosis processing, will be described next.

The microcomputer 2 performs the following <FS1> as the fail-safe processing at S180 of the guard function diagnosis processing performed in the period <1>.

<FS1> The microcomputer 2 stores abnormality information indicating a determination of abnormality at S160 in a non-volatile memory, for example. The microcomputer 2 performs abnormality notification processing, which notifies a vehicle user of an occurrence of abnormality, and starting prohibition processing, which prohibits starting of the engine, when the above-described abnormality information is stored in the non-volatile memory at the time of next activation of the microcomputer 2 as a result of next turn-on of the ignition switch 17.

As the abnormality notification processing, for example, an alarm light may be activated to indicate an occurrence of abnormality, a display device may be activated to display a message of an occurrence of abnormality or a sound device may be activated to generate a voice message indicating an occurrence of abnormality. As the starting prohibition processing, for example, current supply to the starter may be prohibited or fuel injection from the injectors 11 and 12 may be prohibited by setting the current supply prohibition signal Sde outputted to the driving control circuit 5 to the low level.

Since the vehicle is assumed to be parked at a safe place during the period <1>, the fail-safe processing for stopping the engine starting performed in <FS1> is considered to be preferred from the standpoint of safety.

The microcomputer 2 performs the following processing <FS2> as the fail-safe processing at S180 in the guard function diagnosis processing performed during the period <2>.

<FS2> The microcomputer 2 performs the abnormality notification processing and the starting prohibition processing described above.

Since the vehicle is assumed to be parked at a safe place during the period <2> as well, the fail-safe processing for stopping the engine starting performed in <FS2> is considered to be preferred from the standpoint of safety.

The microcomputer 2 performs the following processing <FS3, FS4> as the fail-safe processing at S180 during the guard function diagnosis processing performed during the period <3> or <4>.

<FS3, FS4> The microcomputer 2 performs the abnormality notification processing described above and transfer request processing for requesting a vehicle user (driver) to transfer the vehicle to a safe place as a limp-home operation. Further, the microcomputer 2 performs the injection prohibition processing for prohibiting the fuel injection into the engine after an elapse of a fixed period, for example.

As the transfer request processing, a message requesting a transfer to a safe place may be displayed on a display device or outputted from a sound device. In parallel with the transfer request processing, the engine power output limiting processing may be performed by controlling an open angle of an electronic throttle. As the injection prohibition processing, for example, the current supply prohibition signal Sde outputted to the driving control circuit 5 may be set to the low level.

In the periods <3> and <4>, the vehicle is assumed to be on a road. For this reason, by performing the fail-safe processing <FS3, FS4> described above, the vehicle user is allowed to move the vehicle to the safe place during the period, in which the fuel injection is not prohibited.

<Advantage>

The microcomputer 2 of the ECU 1 performs the continuous short-period driving control in the guard function diagnosis processing shown in FIG. 3 thereby to allow the current to flow in the common current flow path 64 for the period longer than the guard period Tg without causing the fuel injection from the injectors 11 and 12. The microcomputer 2 thus checks at S140 and S150 shown in FIG. 3 whether the current supply period guard circuit 7 normally causes the diving circuit 4 to stop the current supply to the coils 11*a* and 12*a*. Further the microcomputer 2 performs the guard function diagnosis processing of FIG. 3 in the period, during which no fuel is injected into the engine.

For this reason, according to the ECU 1, it is possible to diagnose whether the function of the current supply period guard circuit 7 is normal without affecting the normal fuel injection control for the engine and without causing the injectors 11 and 12 to inject fuel actually and unnecessarily.

Further, the microcomputer 2 determines that the function of the current supply period guard circuit 7 is abnormal (S150: YES and S160), when the current supply to the coil 11*a* and 12*a* is not stopped in spite of the continuous supply of current to the common current flow path 64 by the continuous short-period driving control for the abnormality determination period Tj, which is longer than the guard period Tg. It is thus possible to determine abnormality and normality correctly.

The microcomputer 2 performs the guard function diagnosis processing in the period, during which the ignition switch 17 is in the off-state, in the period <1> described above. In the period, during which the ignition switch 17 is in the off-state, load-driving noise is rarely generated or not generated at all. For this reason, the microcomputer 2 can diagnose the function of the current supply period guard circuit 7 correctly without being affected by the noise, which is generated in driving electric loads other than the injector.

Since the microcomputer 2 performs the guard function diagnosis processing before starting the engine cranking in the period <2>, it is possible to prohibit starting of the engine. It is thus possible to prevent a vehicle from being moved under a state that a safety function provided by the current supply period guard circuit 7 is not secured.

Since the microcomputer 2 performs the guard function diagnosis processing in the period <3> or <4>, the microcomputer 2 can detect an abnormality even when the function of the current supply period guard circuit 7 becomes abnormal in one trip of a vehicle, which is from starting to stopping of the engine.

The microcomputer 2 is not limited to perform the guard function diagnosis processing in all of the periods <1> to <4>. The microcomputer 2 may alternatively be configured to perform the guard diagnosis in at least one of the periods <1> to <4>.

Second Embodiment

An ECU according to a second embodiment will be described next. Same structural components and processing as those of the first embodiment are designated with the same reference numerals thereby to simplify the description.

Figure 6:
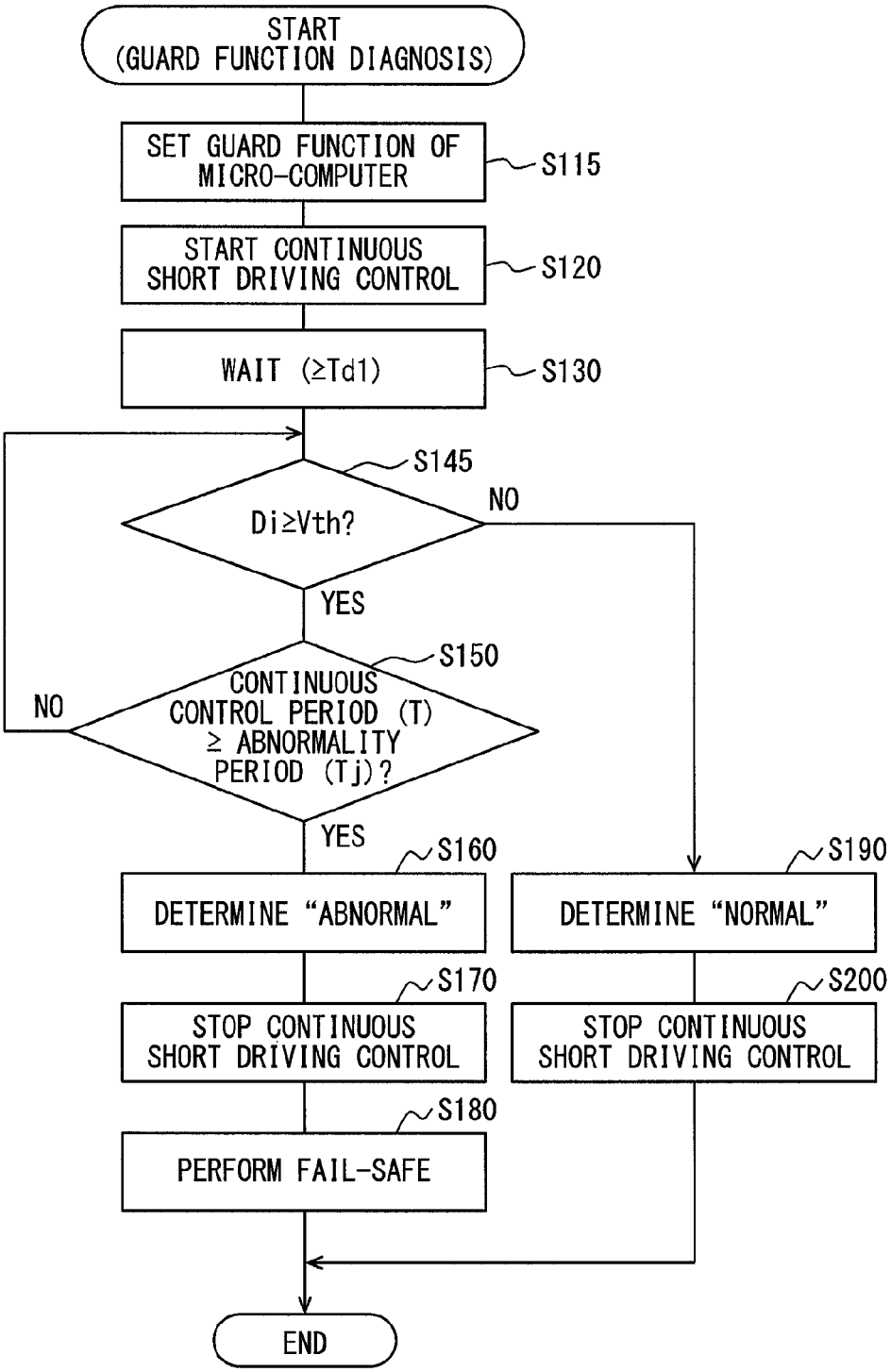
FIG. 6 is a flowchart showing guard function diagnosis processing performed in the second embodiment.

An ECU 9 according to the second embodiment shown in FIG. 6 is different from the ECU 1 of the first embodiment in the following points <a> to <c>.

<a> The current supply period guard circuit 7 is not provided in a hardware configuration.

The current detection signal Vi outputted from the current detection circuit 6 is inputted to the microcomputer 2 as the signal Di.

<b> The microcomputer 2 performs the current supply period guard processing for performing the same function (current supply period guard function) of the current supply period guard circuit 7 by software. The microcomputer 2 therefore performs the current supply period guard function of the microcomputer 2 in the engine power output limitation processing without performing the function of the current supply period guard circuit 7 upon detection of the abnormality that the engine is likely to produce excessive output. Specifically, the microcomputer 2 performs an internal setting for permitting the performance of the current supply period guard processing in place of setting the current supply guard setting signal Sg for the current supply period guard circuit 7 to the high level. Further, the microcomputer 2 sets the guard period Tg in a memory area (referred to as a guard period memory area) of the RAM 23, in which the guard period Tg is stored to be referred to in the current supply period guard processing, for example, in place of setting the guard period Tg relative to the current supply period guard circuit 7.

In the current supply period guard processing, the microcomputer 2 A/D-converts the inputted diagnosis signal Di and checks whether the diagnosis signal Di is equal to or higher than the threshold signal Vth. The microcomputer 2 then measures a period, during which the diagnosis signal Di continues to be equal to or higher than the threshold signal Vth. When a measured period of continuation reaches a set guard period Tg, the microcomputer 2 sets the forced-off command signal Soff for The driving control circuit 5 to the low level. When the forced-off command signal Soff outputted from the microcomputer 2 to the driving control circuit 5 changes to the low level, the current supply to the coils 11*a* and 12*a* are forcibly stopped as in the first embodiment.

Figure 5:
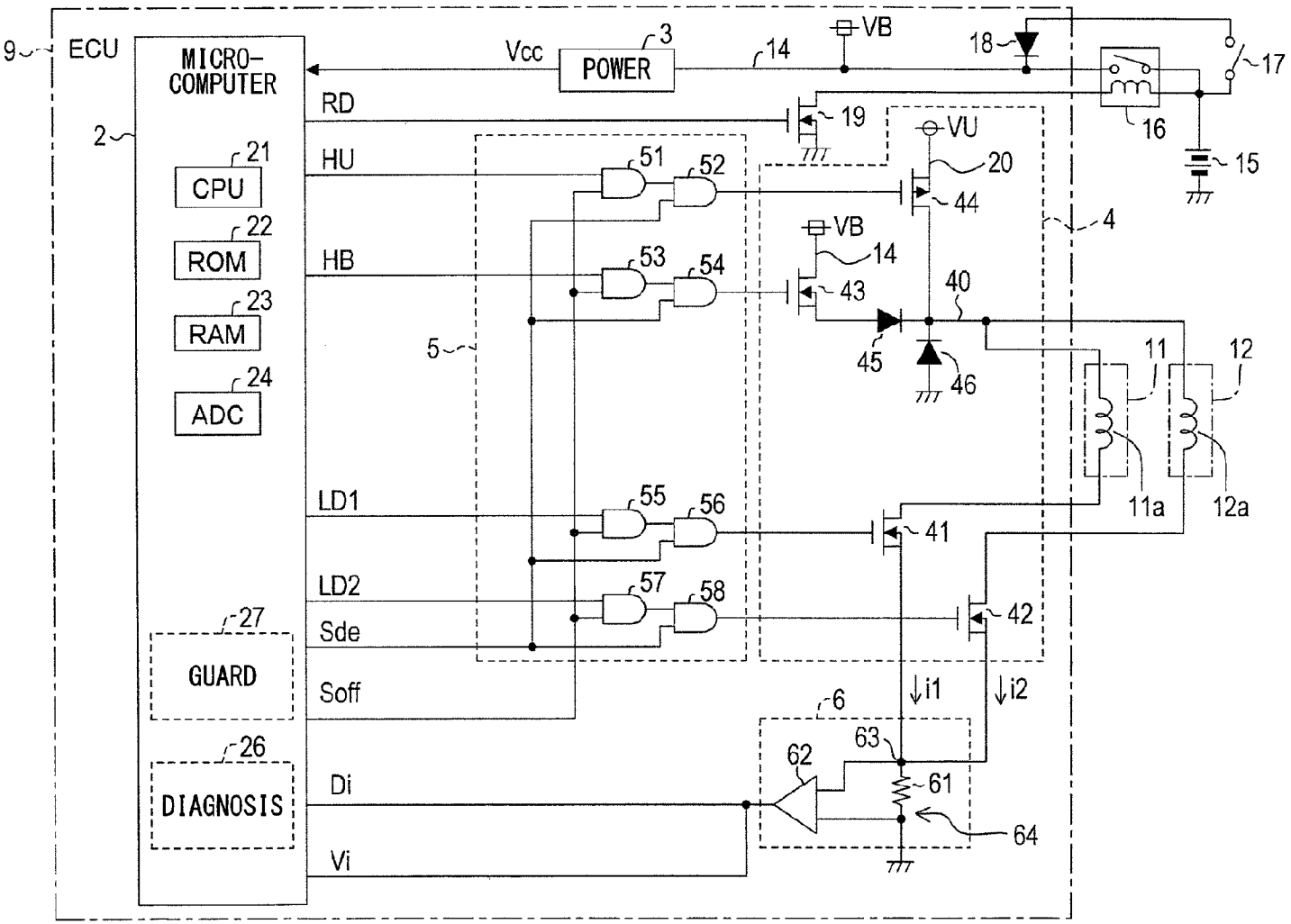
FIG. 5 is a circuit diagram showing a configuration of an injector driving apparatus according to a second embodiment.

In FIG. 5, the guard function part 27 illustrated inside the microcomputer 2 indicates a resource for performing the current supply period guard processing (that is, a resource for performing a current supply period guard function) among resources of the microcomputer 2. The reliability level of the guard function part 27 is higher than that of the fuel injection control processing. For example, it is as high as that of the resource for performing the engine power output limitation processing.

<c> The microcomputer 2 performs the guard function diagnosis processing shown in FIG. 6 in place of the guard function diagnosis processing shown in FIG. 3. The guard function diagnosis processing shown in FIG. 6 is different from the guard function diagnosis processing shown in FIG. 3 in that S115 and S145 are provided in place of S110 and S140, respectively.

The microcomputer 2 performs the current supply period guard function of the microcomputer 2 at S115. Specifically, the microcomputer 2 sets the guard period Tg in the guard period memory area of the RAM 23 and performs the internal setting for permitting performance of the current supply period guard processing.

The microcomputer 2 checks at S145 whether the current detection signal Vi outputted from the current detection circuit 6 is equal to or higher than the threshold signal Vth. This checking at S145 is substantially the same as checking whether the signal Di is at the high level at S140 in FIG. 3. The microcomputer 2 performs S150 upon determination that Di is equal to or higher than Vth at S145. The microcomputer 2 performs S190 upon determination that Di is not equal to nor higher than Vth (that is, Di is lower than Vth) at S145.

The ECU 9 according to the second embodiment also provides the similar advantage as those of the ECU 1 of the first embodiment. Since the ECU 9 is not provided with the current supply period guard circuit 7 in comparison to the ECU 1, the number of hardware structural components may be reduced.

The injector driving apparatus is not limited to the embodiments described above, but may be implemented differently. The numbers and numerical values described above are only exemplary and may be other values. For example, the number of injectors, which are common to the current detection circuit 6, is not limited to 2 but may be equal to or larger than 3. The function of the guard function diagnosis processing may be realized by a hardware circuit, which is separate from the microcomputer 2.

What is claimed is:

1. An injector driving apparatus comprising:

a driving circuit for supplying a current individually to coils of multiple injectors mounted on an engine of a vehicle;

a common current flow path, in which a current flows to the coils in common;

a current detection element provided in the common current flow path for detecting the current flowing in the common current flow path as a current, that flows to the coils;

a current supply period guard part for measuring a period, during which the current continues to flow in the common current flow path, based on a detection result of the current detection element, and forcibly stopping the current supplied from the driving circuit to the coils when a measured period reaches a predetermined set period; and a diagnosis part for checking whether the current supply period guard part normally stops the current supplied from the driving circuit to the coils, by supplying the current to each of the coils for a period shorter than a minimum period, which enables an injector to open a valve, and by sequentially switching over the coils thereby to continuously supply the current to the common current flow path, wherein the diagnosis part performs a checking operation in a period of no fuel injection into the engine.

2. The injector driving apparatus according to claim 1, wherein:

the diagnosis part determines that the current supply period guard part is abnormal when the current is not stopped from being supplied to the coil even in a case of a continuous current supply to the common current flow path for a period longer than the set period.

3. The injector driving apparatus according to claim 1, wherein:

the diagnosis part operates in a period, during which power is supplied to the injector driving apparatus after an ignition switch of the vehicle is turned off.

4. The injector driving apparatus according to claim 1, wherein:

the diagnosis part operates in a period from when an ignition switch of the vehicle is turned on to when an engine cranking is started.

5. The injector driving apparatus according to claim 1, wherein:

the diagnosis means operates in a period, during which the engine is automatically stopped under an idle-stop control.

6. The injector driving apparatus according to claim 1, wherein:

the diagnosis part operates in a period, during which fuel injection to the engine is shut off upon deceleration of the vehicle.

7. The injector driving apparatus according to claim 1, wherein:

the current measured by the current supply period guard part is higher than a set current value.

* * * * *